US006207938B1

(12) United States Patent
Taylor et al.

(10) Patent No.: US 6,207,938 B1
(45) Date of Patent: Mar. 27, 2001

(54) RESISTIVE HEATING TRACK WITH BRIDGE FUSE

(75) Inventors: John Crawshaw Taylor, Castletown; Keith Barrie Doyle, Tetbury, both of (GB)

(73) Assignee: Strix Limited, Ronaldsway (GB)

( * ) Notice: Subject to any disclaimer, the term of this patent is extended or adjusted under 35 U.S.C. 154(b) by 0 days.

(21) Appl. No.: 09/171,379

(22) PCT Filed: Apr. 17, 1997

(86) PCT No.: PCT/GB97/01070

§ 371 Date: Jan. 25, 1999

§ 102(e) Date: Jan. 25, 1999

(87) PCT Pub. No.: WO97/39603

PCT Pub. Date: Oct. 23, 1997

(30) Foreign Application Priority Data

Apr. 18, 1996 (GB) ..... 9608017
Feb. 18, 1997 (GB) ..... 9703340

(51) Int. Cl.[7] ..... H05B 1/02

(52) U.S. Cl. ..... 219/505; 219/504; 219/552; 219/553

(58) Field of Search ..... 219/504, 505, 219/552, 553, 452, 510; 392/498

(56) References Cited

U.S. PATENT DOCUMENTS 3,636,309 * 1/1972 Deaton et al. ..... 219/452
4,076,975 * 2/1978 Tyler et al. ..... 219/483
4,092,520 * 5/1978 Holmes et al. ..... 219/504
4,727,239 * 2/1988 Lupoli et al. ..... 219/208
5,793,929 * 8/1998 Taylor ..... 392/498

FOREIGN PATENT DOCUMENTS

2272619 * 5/1994 (GB) .

* cited by examiner

*Primary Examiner*—Teresa Walberg
*Assistant Examiner*—Jeffrey Pwu
(74) *Attorney, Agent, or Firm*—Testa, Hurwitz & Thibeault, LLP

(57) ABSTRACT

An electrical resistance or heater includes an electrical resistive track provided on an insulating substrate. Two predetermined sections of the track have a predetermined current carrying capacity and are bridged by a glass, ceramic, or glass ceramic material. The configuration of the track and the glass material are such that at a predetermined temperature, the leakage current between the track sections rises to the extent that it causes a current to flow through one or both of the sections which is substantially above its current carrying capability, whereby one section fails.

17 Claims, 1 Drawing Sheet

RESISTIVE HEATING TRACK WITH BRIDGE FUSE

Figure 1:
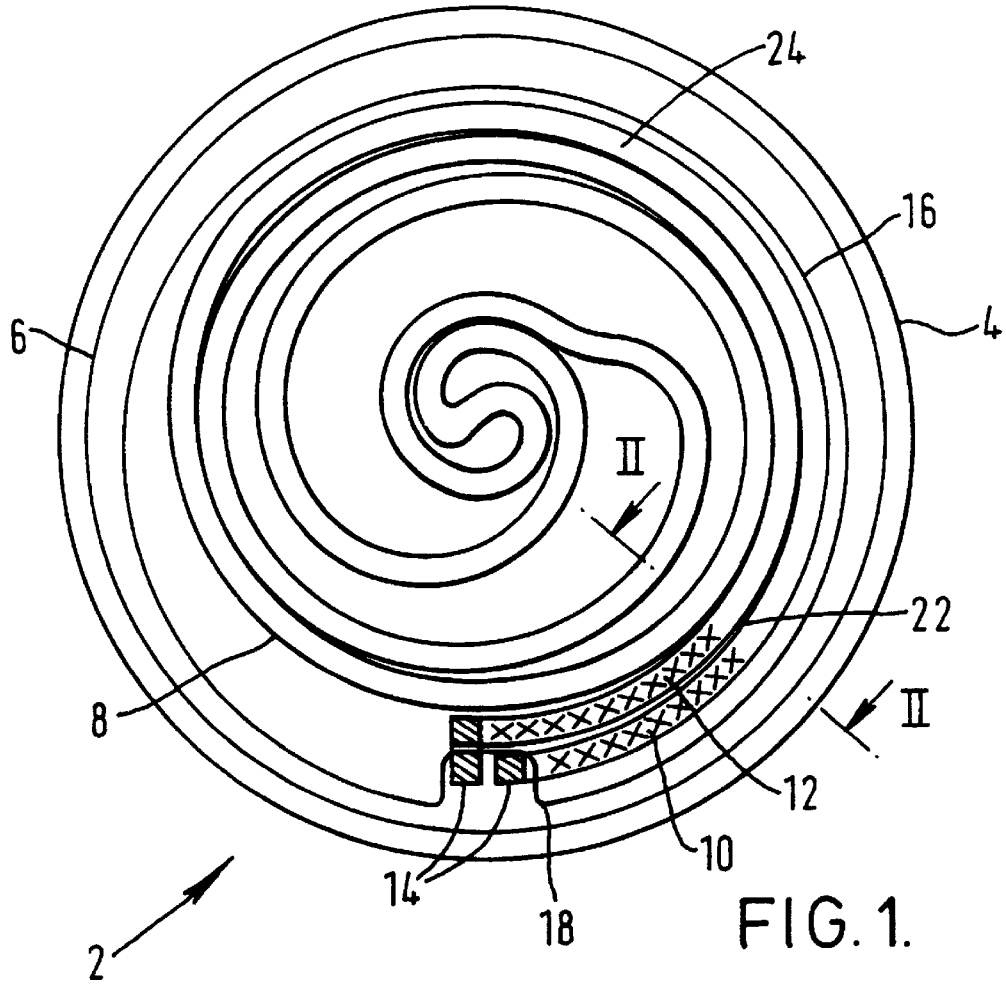

The present invention relates to electric resistances and heaters and in particular to electric resistances and heaters of the type comprising a resistive track provided on an insulating substrate.

Such resistances are used, for example, in controls for electrical appliances, such as motor, fans, etc. while such heaters are used or have been proposed for use in a variety of applications, for example in domestic appliances such as water heating vessels, water heaters and irons. Typically a glass, ceramic, or glass ceramic insulating layer is provided on a metallic base such as a plate (which may for example form a part of the base of a liquid heating vessel) and the resistive track laid down on the insulating layer, usually by a printing technique. A further electrical insulating layer may be applied over the track to protect it and prevent corrosion and oxidation.

It is clearly important that the resistance or heater should not be allowed to seriously overheat in a fault condition since this may cause substantial damage not only to the device or appliance in which it is being used, but also, potentially, to users thereof. Accordingly, in liquid heating vessels, it is common to provide a resettable overheat protector which operates in the event that the heater of the vessel overheats, for example if it is switched on without liquid in it or if it boils dry. Typically, this comprises a bimetallic actuator arranged in thermal contact with the heater and which operates at a given temperature, above the normal operating temperature of the vessel to open a set of contacts in the supply to the heater. However in the event that this protector should fail to operate it is also known to provide a back-up protector, for example a thermal fuse which will operate in the event that the temperature of the heater rises above a predetermined value.

In WO-A-94/18807, for example a thermally deformable fuse member is spring loaded against a part of the heater. When the heater temperature rises above a given temperature, the thermally deformable fuse member softens and deforms under its spring force, so as to open a set of contacts in the electrical supply to the heater, thereby disabling it. However, it is preferable to provide a heater or resistance with built-in protection.

It has been proposed therefore to include a thermal fuse in the track itself. In one arrangement, used in resistances for controlling fans in car heating systems a solder bridge is formed over a gap in the heating track. The solder is chosen to melt at a predetermined temperature, thereby opening the gap in the track, to break the electrical supply. This type of fuse has, however, several disadvantages. Firstly it is difficult to manufacture and in particular to obtain the required current carrying capacity in the fuse. Secondly, it is relatively slow to operate, as it relies upon surface tension effects in the molten solder to separate the fuse. Thirdly, solders can only be used over a limited temperature range, thereby limiting their range of operation. Also, since these solders are eutectics, over time they may change their crystalline structure which may result in the operating temperature varying. Finally, they are easily damaged for example in transit, storage or assembly, since any flexing of the substrate can break the electrical contact to the fuse.

The Applicant has now devised a new form of resistance or heater which attempts to address the above problems. It has been recognised by the Applicant that the electrical insulating properties of glass, ceramic or glass ceramic materials (collectively hereafter termed "glasses") may be used in the overheat protection of resistances or heaters. In particular, the electrical resistance of glasses changes as the glass temperature rises. Whilst a glass may be an insulator at room temperature or at normal operating temperatures, its electrical resistance may drop considerably, indeed by several orders of magnitude, at higher temperatures approaching its melting point. By choosing a glass material with the appropriate resistance characteristics, and applying it between selected portions of a resistive track rated to operate with a given supply current, the Applicants have found that a predetermined portion of the track can be made to overheat before the whole heater or resistor overheats. A portion of the normal track can thus be made to operate, effectively, as a thermal fuse.

In particular, at normal operating temperatures the glass will act substantially as an electrical insulator, leading to a very small leakage current between the track sections. However, when the temperature of the heater track rises above normal (as would happen in an abnormal over-heat condition), the glass temperature will rise, thereby leading to a reduction in its resistance. This in turn will lead to an increase in the leakage current between the track sections. This will lead to a greater current flowing through the track sections, which increases the heating effect and so on. This is a self-perpetuating process which will result in the glass being heated internally by virtue of the leakage current flowing therethrough, which very quickly leads to the leakage current between the track sections running away, leading to the current in the track sections bridged by the glass exceeding its design rating, so that that part of the track will vaporise thereby disabling the resistance or heater.

From a first aspect, therefore, the invention provides a resistance or heater of the type comprising an electrical resistive track provided on an insulating substrate, two predetermined sections of said track having a predetermined current carrying capacity being bridged by a glass material, the configuration of the track, and the glass material being chosen such that at a predetermined temperature, the leakage current between the track sections rises to the extent that it causes a current to flow through one or both of said sections which is substantially above its current carrying capability, whereby a section fails.

The invention thus provides a self-fusing resistance or heater which does not rely upon external safety devices and which obviates the need for the use of solders, as described above. By choosing an appropriate glass material and track configuration, a track designer may predetermine where, when, and at what temperature, the track will fail in a controlled manner.

From a second aspect, therefore the invention provides a method of manufacturing an electrical resistance or heater of the type comprising an electrical resistance track provided on an insulating substrate, comprising providing a bridge of glass material between two selected sections of the track capable of carrying a normal predetermined current, the position of said bridge being predetermined such that above a predetermined temperature the leakage current between said sections will rise to the extent that the current flowing through a section of the track rises above its normal predetermined current, causing it to fail.

The glass may be applied merely as a discrete bridge between the selected track sections. Preferably, however, for ease of manufacture, the glass is applied over the track sections as an overglaze. The overglaze may be local to the track sections to be bridged, but preferably it extends over a substantial portion, most preferably substantially the whole of the track so as in addition to protect the track eg.

from corrosion and oxidation in normal operating conditions. This is particularly so when the overglaze is one which will become conductive at high temperatures, e.g. 850° C.–900°C., where the track would otherwise oxidise and fail.

The leakage current between the track sections through the glass material will depend both on the voltage gradient between the track sections and the temperature of the glass. The glass temperature at a given position is at least initially determined by the local temperature of the heater or resistance. This temperature in turn will depend on the local power density of the heater or resistance. Whilst under normal operating conditions, this will not be significant, since heat will be conducted away from the area by, say liquid in a heating vessel, in a fault condition, the local temperature will rise more quickly in regions of the heater/resistance with higher power densities. Thus the position at which the track failure will occur can be predetermined by the designer by setting these parameters at that position to appropriate values. The bridge is preferably provided in a region where the voltage gradient is relatively high, most preferably a maximum for the track. Thus the bridged sections of the track are most preferably arranged adjacent the respective ends of the track, to maximise the voltage differential therebetween, and preferably they are arranged closely adjacent each other, to maximise the voltage gradient.

Furthermore, the power density of the heater or resistance is preferably a maximum in the region of the bridged sections of the track, thereby maximising the heating of the glass bridge region in an overheat condition. This will assist in raising the temperature of the glass in that region quickly to the point at which run-away of the leakage current occurs.

The local power density can be increased by, for example, increasing the actual heat generated in the track at that point, or by moving the track sections closer together.

Thus for particularly efficient operation, the voltage gradient and power density of the heater should be maximised in the region of the bridge. From a further aspect, therefore, the invention provides an electrical resistance or heater of the type comprising a resistive track laid down on an insulating substrate wherein a glass bridge is provided between two sections of the track in a region in which the voltage gradient between adjacent sections of the track and the power density of the resistance or heater are both a maximum.

The particular glass used in the invention may be chosen to provide a desired maximum overheat temperature for the heater. What is needed is a glass whose resistance under normal operating temperatures will not reduce to the point at which the leakage current will run away. One example is ESL 4770 BCG manufactured by Agmet. This is stable at operating temperatures of 150–200° C., and melts at approximately 450° C., and will fail at or around that temperature.

The insulating substrate, heater track and glass overglaze may be applied to a support such as a stainless steel plate by any suitable method, such as printing, spraying or transfer and the invention is not intended to be limited to any particular method of manufacture.

It is believed that the invention may have broader application than to just heaters as described above, but may also be used to protect other electrical devices such as motors or even resistors. In very broad terms, therefore the invention extends to overheat protection means for an electrical device comprising an electrically insulating glass (as herein defined), whose electrical resistance falls as its temperature increases, said glass being arranged so as to bridge a fuse, and chosen such that upon its temperature rising above a given temperature the current in the fuse is caused to rise above its maximum rated value, causing the fuse to fail.

Thus considered very broadly, the invention provides a fuse triggered by the glass reaching a predetermined temperature and providing a low resistance flow path which results in a current flowing above the design load of the fuse.

Whilst the fuse may be provided at any suitable location in the device or electrical circuit, it may be a unit which may be inserted in an appropriate part of the electrical supply to the device. From a further broad aspect, therefore the invention provides a fuse for protecting an electrical device comprising an electrical conductor designed to carry a predetermined electrical current and having two sections bridged by an electrically insulating glass (as herein defined), such that when the glass is heated above a predetermined temperature, it forms a conductive path between the sections, causing the current in the conductor to rise above its predetermined maximum value and the conductor to fail.

Figure 2:
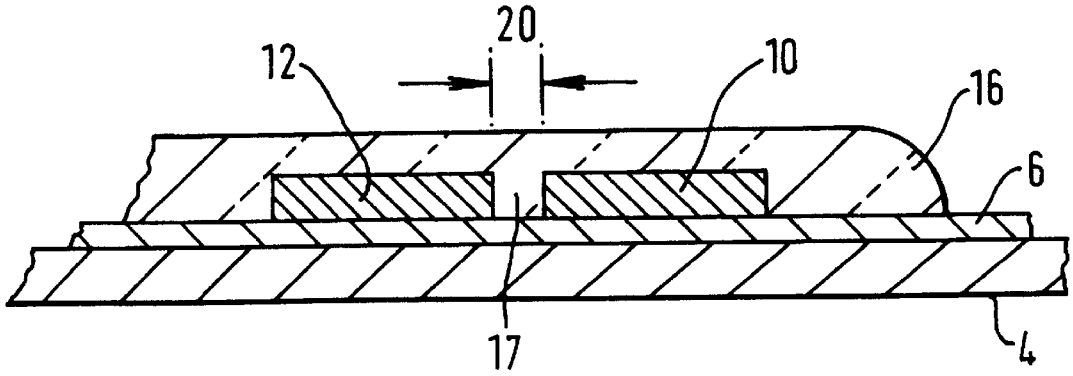

A preferred embodiment of the invention will now be described by way of example with reference to the accompanying drawings in which:

FIG. 1 is a schematic plan view of a heater in accordance with the invention; and FIG. 2 is a schematic section along line II—II of FIG. 1.

With reference to the Figures, a heater 2 comprises a stainless steel (or other metal) plate 4 approximately 0.5 mm thick and on which is provided, in any suitable manner, an insulating glass layer 6. In this embodiment, the glass is a 100 $\mu$m thick layer of MZB550 (Cera Dynamic). The plate may form, for example, a part of the base of a liquid heating vessel. A tortuous, electrically resistive heating track 8 of a conventional material is laid down on the layer 6, again by any suitable method such as printing, spraying or so on. In this embodiment the track material is ESL 2900-0.1 and the track 8 is 13 $\mu$m thick, and 4mm wide. The total track resistance is about 26 Ω. The track 8 has respective end sections 10,12 which in use are connected to an electrical supply through contact pads 14 again provided on the track in any suitable manner.

Adjacent sections of the track are separated by a gap 20. The gap 20 between the end sections 10,12 reduces to a minimum value of about 0.5 mm at the point indicated by reference numeral 22. Elsewhere the track is configured to leave a gap 20 of at least 1 mm between adjacent sections. With a 240 V supply, therefore, the voltage gradient at that point is about 240/0.5=480 $Vmm^{-1}$. This is the maximum value of voltage gradient over the track. Furthermore the power density of the heater at that point is maximised to be about 44 $Wcm^{-2}$ (taken over the area of the tracks 10,12 and the gap 20) ensuring that the maximum heating effect occurs at that point. This is because, although the track has a constant width, and thus heating effect over its entire length, as the track is closest together in this region, the heat being produced in that region is greatest.

The whole track 8 is overlaid by a protective glass overglaze 16, which has a peripheral notch 18 to allow access to the contact pads 14. The overglaze layer 16 provides a bridge 17 between the track end sections 10,12. In this particular embodiment, the glass is ESL 4770 BCG produced by Agmet, and has a melting point of about 450° C. The electrical resistance of the glass drops very substantially as it approaches that temperature so as to provide an overheat protection feature as will be described further below.

In the case, for example, where the heater is used in the base of a liquid heating vessel, the heater 2 will be maintained at around 100–120°C. by the cooling effect of the liquid in the vessel. However, should the vessel boil dry or be switched on dry, the heater temperature will rise very rapidly. Although most vessels will be provided with some form of "primary" overheat protector, which will operate say when the temperature exceeds about 150° C., if that should fail, the temperature of the heater will continue to rise very rapidly and if unchecked, it could explode. However by virtue of the present invention the glass overglaze layer 16 will act to prevent the whole track 8 overheating catastrophically and thereby potentially causing substantial damage.

In this regard, as current continues to be supplied to the heater track 16, it will continue to rise in temperature. Since the power density of the heater is maximised at point 22, this area will rise in temperature most quickly. Accordingly the glass overglaze layer 16 in this region will be heated most quickly. As it is heated its electrical resistance begins to drop, which means that the current leaking between the track end sections 10,12 though the bridge 17 and begins to increase. This will cause the current flowing through the end sections 10,12 to increase, in turn causing their heating effect to increase, which further heats the glass layer 16 so that its resistance drops, which further increases the leakage current. Eventually the current flowing through the glass is such that the glass is internally heated, which leads very rapidly to the leakage current running away. In this event, the section 24 of the track 16 beyond point 22 effectively becomes short circuited.

Typically the total resistance of the track 8 presented to the contact pads 14 is reduced from say 26 Ω (chosen to give a nominal power of 2200 W with a 240V supply) to about 3Ω. This leads to a current of about 80 A (as opposed normally to about 10 A) suddenly flowing through the track sections 10,12. These sections are not designed to carry such a high current at such temperatures, and so vaporise, practically instantaneously. This acts to disconnect the power supply from the rest of the heater track 16, thereby preventing further overheating.

It has been found in tests that the arrangement described above operates so quickly that once the glass layer short circuits the track 16, a normal 13 A fuse in series with the track 16 remains intact.

It will be appreciated that the invention is not limited to the particular embodiment above. For example, different glasses having different melting points may be chosen to give desired operating temperatures and maximum temperature for the heater. Furthermore, different track geometries can be used to accommodate different applications.

In the embodiment described above, the track sections 10,12 will fail extremely quickly, typically within 2–3 seconds of the heater being energised in a dry switch on condition. It may not always be desirable to have such a rapid response, since under normal conditions a primary overheat protector such as a bimetallic actuator could take typically 7 seconds to operate. Accordingly, in the above embodiment, the track sections 10,12 will vaporise before the actuator has operated.

The length of time to failure can be extended in a number of ways. Firstly, as is suggested above, the overglaze material may be changed. To illustrate this, a heater having the same track shape as discussed above and comprising 90 μm insulating layer of ESL4914 laid down on 0.5 mm thick stainless steel plate with a 13 μm thick resistive heating track of ESL 2900-0.1 and a 13 μm overglaze of ESL 4770-BCG, when switched on dry at a power of 2.2 kw will fail within about 2 seconds. However, with a 13 μm overglaze of ESL4914 (which becomes conductive at around 850–900° C. rather than at about 350° C.) the track will not fail for about 15 seconds. This will allow a sufficiently large operating margin over the primary protector so that the track will not fail prematurely.

An important factor in using higher temperature overglazes is that, whereas in lower temperature application a discrete bridge of glass may be provided between sections of the track, in higher temperature applications, the overglaze should be provided over the whole of the track so as to prevent the track material oxidising and failing at higher temperatures.

A further factor which will increase the time to failure of a heater in accordance with the invention is the thickness of the substrate on which it is provided. For example, in the last example above, if the thickness of the stainless steel support is increased from 0.5 mm to 1.5 mm, the time to failure increases from about 15 seconds to about 30 seconds.

A yet further way in which the time to failure can be increased is by using a track material having a positive temperature coefficient of resistance (PTCR). In such materials, the resistance of the track material increases with temperature, so that as the temperature increases, the heat generated by the tracks (which is inversely proportional to the square of the track resistance) falls, thereby reducing the heating effect, and thus delaying the onset of thermal narrowing on the glass.

It will thus be seen that by judicious choice of the thickness of the support, track material and geometry and the overglaze material, a desired track failure time can be achieved.

What is claimed is:

1. An electrical heater comprising an electrical resistive heating track provided on an insulating substrate, two predetermined sections of said track having a predetermined current carrying capacity being bridged by a glass material forming a glass bridge, the configuration of the track and the glass material being chosen such that at a predetermined temperature, a leakage current between the track sections rises to an extent that a current flows through one or both of said sections which is substantially above the current carrying capacity thereof, whereby said section fails.

2. A heater as claimed in claim 1 wherein the glass material is arranged to form a discrete bridge between the track sections.

3. A heater as claimed in claim 1 wherein the glass material is applied as an overglaze to the track sections.

4. A heater as claimed in claim 3 wherein the overglaze extends over a substantial portion of the track.

5. A heater as claimed in claim 1 wherein the bridged sections of the track are respective end sections of the track.

6. A heater as claimed in claim 1 wherein the bridged sections of the track are most closely spaced apart sections of the track.

7. A heater as claimed in claim 1 wherein the track sections are configured to provide a maximum voltage gradient therebetween in a region of the glass bridge.

8. A heater as claimed in claim 1 wherein the track sections are configured and arranged to provide a localised maximum power density in a region of the glass bridge.

9. An electrical appliance comprising an electrical heater comprising an electrical resistive heating track provided on an insulating substrate, two predetermined sections of said track having a predetermined current carrying capacity being bridged by a glass material forming a glass bridge, the configuration of the track and the glass material being chosen such that at a predetermined temperature, a leakage current between the track sections rises to an extent that a current flows through one or both of said sections which is substantially above the current carrying capacity thereof whereby said section fails.

10. An appliance as claimed in claim 9 wherein said appliance is a liquid heating vessel, and said heater forms or is attached to at least a part of a base of the vessel.

11. An overheat protection means for an electrical heater, comprising an electrically insulating glass for bridging two sections of electrical resistive heating track, wherein electrical resistance of the insulating glass falls as a temperature thereof increases, said glass being arranged so as to bridge a fuse, and being chosen such that upon the temperature thereof rising above a given value, current in the fuse is caused to rise above a maximum rated value, causing the fuse to fail.

12. A fuse for protecting an electrical heater from overheating comprising an electrical resistive heating conductor designed to carry a predetermined electrical current and having two sections bridged by an electrically insulating glass such that when the glass is heated above a predetermined temperature, the glass forms a conductive path between the sections, causing the current in the conductor to rise above a predetermined design value and the conductor to fail.

13. A method of manufacturing an electrical heater comprising an electrical resistive track provided on an insulating substrate, comprising providing a bridge of glass material between two selected sections of the track capable of carrying a maximum predetermined current, the position of said bridge being predetermined such that above a predetermined temperature, leakage current between said sections will rise such that the current flowing through said section of the track rises above a maximum predetermined current, causing said section to fail.

14. An electrical heater comprising a resistive track laid down on an insulating substrate wherein a glass bridge is provided between two sections of the track in a position at which a voltage gradient between adjacent sections of the track and a local power density of the heater are a maximum.

15. An electrical resistance comprising an electrical resistive track provided on an insulating substrate, two predetermined sections of said track having a predetermined current carrying capacity being bridged by a glass material, a configuration of the track and the glass material being chosen such that at a predetermined temperature, a leakage current between the track sections rises to cause a current to flow through one or both of said sections which is substantially above a current carrying capacity thereof, whereby said section fails.

16. A heater as claimed in claim 4 wherein the bridged sections of the track are closely adjacent and the track is configured to provide a maximum voltage gradient between adjacent track portions in a region of the glass bridge.

17. A heater as claimed in claim 16 wherein the track sections are configured and arranged to provide a localised maximum power density in the region of the glass bridge.

* * * * *